United States Patent [19]

Seiler et al.

[11] Patent Number: 4,703,505

[45] Date of Patent: Oct. 27, 1987

[54] SPEECH DATA ENCODING SCHEME

[75] Inventors: Norman C. Seiler, West Melbourne, Fla.; Stephen S. Walker, Lilburn, Ga.

[73] Assignee: Harris Corporation, Melbourne, Fla.

[21] Appl. No.: 526,065

[22] Filed: Aug. 24, 1983

[51] Int. Cl.[4] ..... G10L 5/00

[52] U.S. Cl. ..... 381/51

[58] Field of Search ..... 381/30–39, 381/51–53

[56] References Cited

U.S. PATENT DOCUMENTS

| | | | |
|---|---|---|---|
| 4,199,722 | 4/1980 | Paz . | |
| 4,209,836 | 6/1980 | Wiggins, Jr. et al. . | |
| 4,301,328 | 11/1981 | Dorais | 381/51 |
| 4,304,964 | 12/1981 | Wiggins, Jr. et al. | 381/51 |
| 4,304,965 | 12/1981 | Blanton et al. . | |
| 4,441,201 | 4/1984 | Henderson et al. | 381/51 |

*Primary Examiner*—E. S. Matt Kemeny
*Attorney, Agent, or Firm*—Barnes & Thornburg

[57] ABSTRACT

A coding scheme which uses Shannon-Fano coding for data headers to identify the type of command signal, uses a first set of formant data in the command signal to generate second sets of formant data for sound class initialization, and uses delta modulation to update the initialized sound class and for sound type transitions. The header indicates initialization of sound classes, repeat of the previous command, updating the previous command or end of word. Given types of command signals and sound classes have the same header and the data portion of the command signal defines which type of command signal is present. A unique delta modulation scheme is used wherein an increment, decrement or no change is indicated by a 11, a 00 or a 10 or 01 wherein each pair represents the delta modulation bit for a parameter, one in the present frame and one in the previous frame for that parameter. A repeat code with no data is used when the delta modulation bit for all parameters change from the previous frame.

13 Claims, 7 Drawing Figures

* "A" FILE IS THE ANALYZED SPEECH DATA FILE FOR WORD/SOUND TO BE ENCODED.

** "C" FILE IS THE ENCODED SPEECH FILE CONTAINING COMMAND HEADER PLUS DATA FOR EACH FRAME.

*NOTE: THERE IS NO "ZERO" FRAME NUMBER. ZERO IS USED AS FIRST VALUE OF X BECAUSE DATA FOR FRAME 1 MUST BE DECODED AND SET UP BEFORE FRAME 1 ACTUALLY BEGINS. NOTATION USED HERE IS CONSISTENT WITH TEXT.

SPEECH DATA ENCODING SCHEME

BACKGROUND OF THE INVENTION

The present invention relates generally to speech synthesizers and, more specifically, to a memory-efficient speech data encoding scheme.

The application of digital and analog network synthesis to the generation of artificial speech has been an area of active research interest for over two decades. Methods of implementing speech synthesizers range from digital algorithms in a large-scale mainframe-based systems to VLSI components intended for commercial consumption. Analysis and synthesis techniques most commonly used for speech processing rely upon concepts such as LPC (Linear Predictive Coding), PARCOR (Partial Autocorrelation), CVSD (Continuously Variable Slope Delta Modulation) and waveform compression. Generally, these methods share either or both of two deficiencies: (1) the speech quality is sufficiently coarse or mechanical to become annoying after repeated listening sessions, and (2) the bit rate of the associated encoding scheme is too high to permit memory efficient realization of large vocabulary systems. To date, these limitations have restricted high-volume application of speech synthesizers to the consumer marketplace.

Techniques for defining useful speech synthesizer parameters and extracting time-varying values from actual human speech are diverse. Such procedures fall under the general categories of "speech data extraction" and "speech parameter tracking." Such methods usually involve digitization of original human speech followed by successive application of many complex algorithms in order to produce useful parameter values. These algorithms must be implemented on digital computers and normally do not produce speech data in real time. In addition to computer speech analysis and parameterization from digitized human speech, other methods of deriving the synthesizer parameters may include visual analysis of speech waveforms on sonograph plots, artificial parameter generation by rule, and conversion from analysis data assembled by other synthesis methods.

Once the speech data has been generated, it is desirable to reduce it to some binary format which allows convenient and efficient storage in the memory space of the synthesizer. Methods for achieving this are often termed "speech data compression" or "speech data reduction" and the binary data formats they produce are generally referred to as "speech data coding schemes." The reduction methods are usually implemented as digital algorithms which operate on the output of the parameter tracking routines. To be properly and usefully implemented, a speech data encoding scheme must contain values for all synthesizer parameters necessary for high-quality speech reproduction and should permit storage of these values in significantly less memory space than that required by the output of the parameter tracking routine itself.

Most speech synthesizers and their associated data extraction and compression algorithms are "frame" oriented. A frame is defined as a small fixed time segment of the original speech waveform. The frame duration is short enough (usually on the order of 10 msec) so that the speech signal does not vary greatly during that interval. Thus, the analysis algorithms divide the original speech signal into successive, discrete time intervals, or frames, of uniform duration and extract sets of parameter values for each frame. The data reduction algorithms then condense these values into the encoding scheme which, in turn, is stored in memory. The encoded data are thus bit packets which are also oriented successively in time by frames.

The synthesizer accesses the speech memory at the same frame rate used to analyze the original speech and code the data. During each frame, a single packet of encoded speech data is read into the synthesizer. Each bit packet must contain two general classes of information: (1) an instruction containing the type of sound or speech to be generated (synthesizer architecture configuration), and (2) the encoded speech parameter data required to produce the speech segment. The coding technique by which this is accomplished directly affects the size of the memory necessary to store all the data packets required for any given synthetic utterance.

A figure of merit, called the "bit rate," has been defined for data coding schemes as a measure of performance. The bit rate is the ratio of memory size requirement (binary data) to corresponding speech segment duration (seconds). Given equivalent speech quality, a coding scheme with a low bit rate is considered to be more efficient than a scheme with a higher bit rate. There is, however, a rough correlation between bit rate and speech quality over wide ranges of bit rate when many different coding schemes are considered.

Phoneme synthesizers generally have a bit rate on the order of 100 bits per second and produce a synthesizer with mechanical sound. Linear predictive coding and waveform compression achieve substantially better speech quality, but require a bit rate on the order of 1000 bits per second. Substantially optimum speech quality is achieved by CVSD and pulse code modulation at a bit rate at or above 16,000 per bits per second. Formant synthesis has the capability of producing speech quality between LPC and CVSD at a bit rate less than LPC which is counter to the general relationship between speech quality and bit rate of prior art methods.

An example of data compression for linear predictive coding is described in U.S. Pat. No. 4,209,836 to Wiggins, Jr., et al. wherein a 6000 bits per second scheme is reduced to 1000 to 1200 bits per second. Recognizing that formant data can be stored more efficiently than the reflective coefficients of linear predictive coding, U.S. Pat. No. 4,304,965 to Blanton et al. uses formant data for storage at an equivalent bit rate as low as 300 bits per second and converts it to LPC type reflective coeffecients for use in an LPC-based speech synthesizer.

There is a need to provide a data compression scheme for formant based synthesizer having reduced memory requirements while maintaining speech quality.

SUMMARY OF THE INVENTION

An object of the present invention is to provide a formant-based coding scheme which reduces storage requirements while maintaining speech quality.

Another object of the present invention is to minimize the data bit rate and storage by judicial selection of independently variable formant parameters.

Still another object of the present invention is to provide an improved delta modulation scheme applicable to any communication system.

These and other objects of the invention are attained by a coding scheme which uses Shannon-Fano coding for data headers to identify the type of command signal, uses a first set of formant data in the command signal to generate second sets of formant data for sound class initialization, and uses delta modulation to update the initialized sound class and for sound type transitions. The header indicates initialization of sound classes, repeat of the previous command, updating the previous command or end of word. Given types of command signals and sound classes have the same header and the data portion of the command signal defines which type of command signal is present.

A unique delta modulation scheme is used wherein an increment, decrement or no change is indicated by a 11, a 00 or a 10 or 01 wherein each pair represents the delta modulation bit for a parameter, one in the present frame and one in the previous frame for that parameter. A repeat code with no data is used when the delta modulation bit for all parameters change from the previous frame.

Other objects, advantages and novel features of the present invention will become apparent from the following detailed description of the invention when considered in conjunction with the accompanying drawings.

DESCRIPTION OF THE PREFERRED EMBODIMENTS

Figure 1:
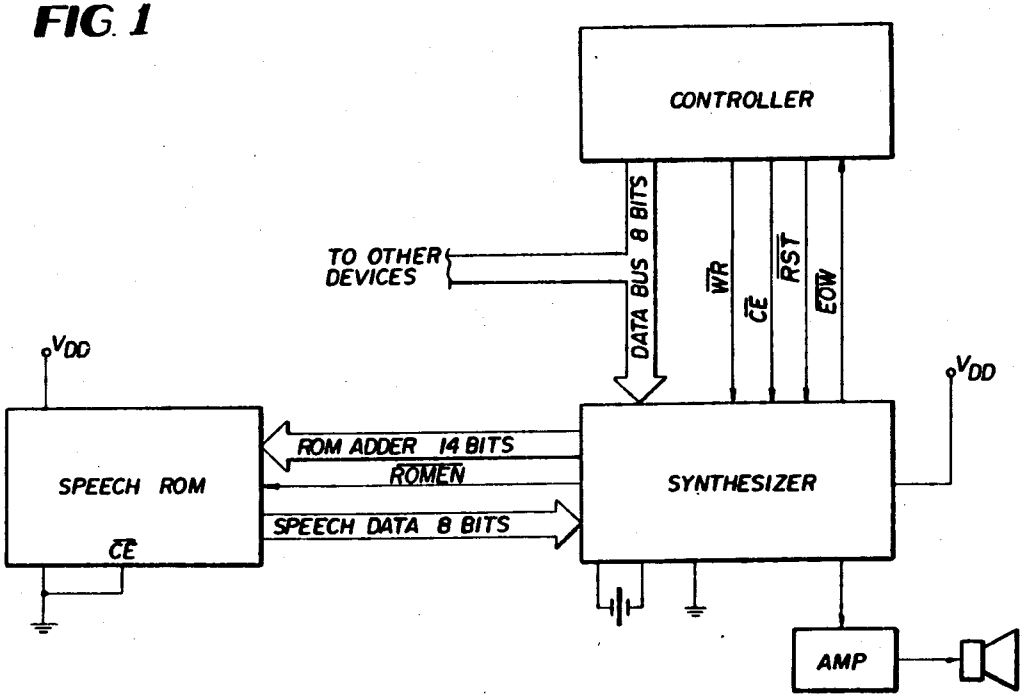
FIG. 1 is a block diagram of the interconnection of a voice synthesizer, speech ROM and micro-controller.

Generation of synthetic human speech typically requires a system similar to that illustrated in block diagram form in FIG. 1. The diagram details a monolithic, integrated circuit approach to synthesis, but functionally identical systems may be realized via other methods such as discrete circuitry or digital computer software packages. The speech generation system consists of four principle parts: (1) a controller function which determines when speech will be generated and what will be spoken; (2) a synthesizer block which functions as an artificial human vocal tract or waveform generator to produce the speech; (3) a data bank or memory containing the speech (vocal tract) parameter values required by the synthesizer to generate the various words and sounds which constitute its vocabulary; (4) an audio amplifier, filter, and loudspeaker to convert the electrical signal to an acoustic waveform.

As illustrated in FIG. 1, fourteen ROM address lines are supplied, allowing access to 131 K bit memories. At 500 bits per second, this corresponds to 26 seconds of speech. This capacity will be adequate for nearly all possible applications. Data buses for the ROM and controller are separated to avoid bus contention and a total of five handshake lines are required.

The controller sends an eight bit indirect utterance address to the synthesizer which in turn uses this information to access the two byte start-of-utterance address located in the lowest page of the speech ROM. The controller's data is flagged valid with write-bar $\overline{WR}$. The utterance address is output on the ROM Address bus lines and the speech data is accessed by byte until an "end of word" (EOW) code is encountered. Such a code results in termination of the speech generation and the transmission of an interrupt code to the controller via the $\overline{EOW}$ line. The $\overline{ROMEN}$ line is available for memory clocking, where necessary, and the RST line resets the synthesizer for the next word. An external power amplifier will be required to drive an 8 ohm speaker.

Figure 2:
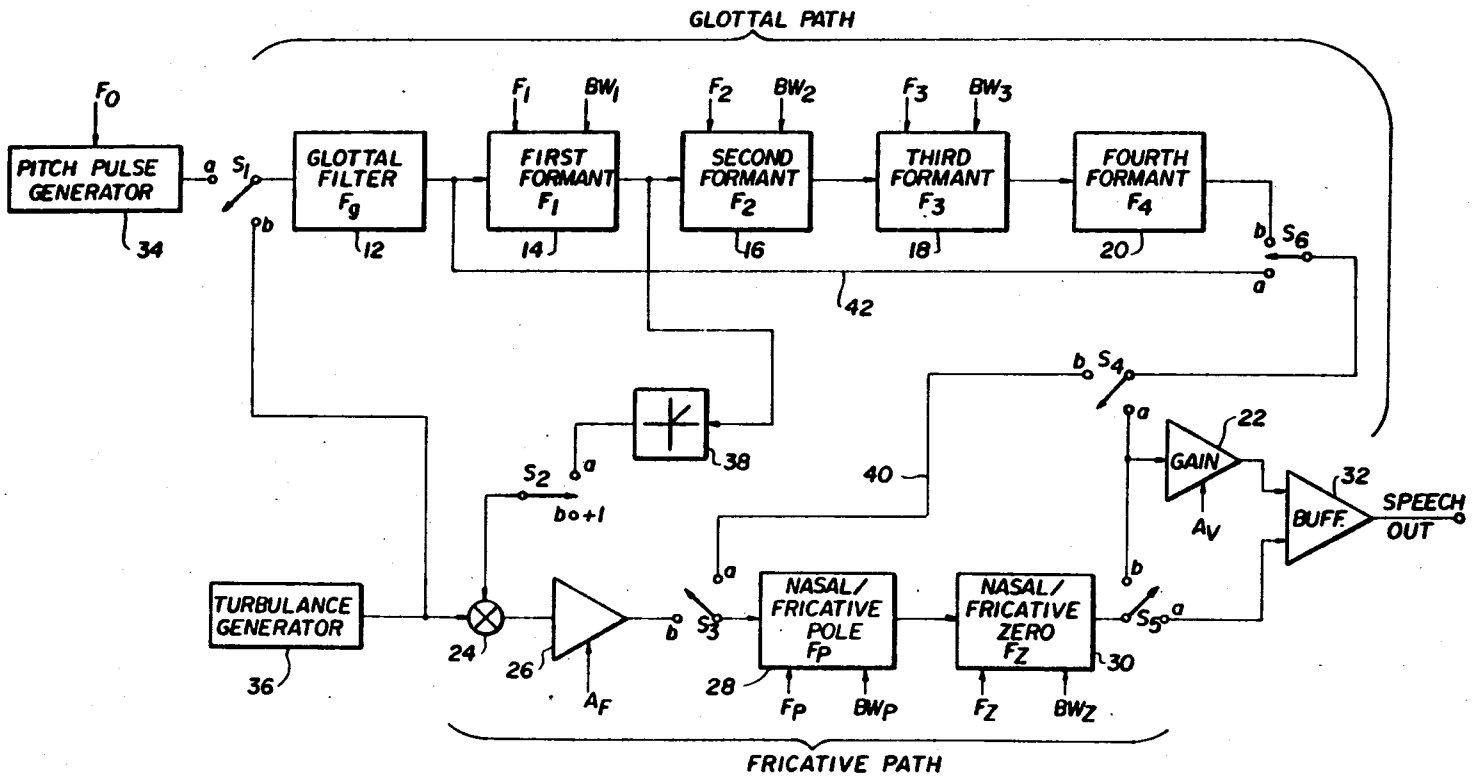
FIG. 2 is a block diagram of the architecture of a vocal track model.

A vocal tract model of a formant-based speech synthesizer is illustrated in FIG. 2. It includes a glottal (voiced) path in parallel with a fricative path. The glottal path includes a glottal or spectral shaping filter 12; first, second, third and fourth formant filters 14, 16, 18, 20, respectively; and a variable glottal-path attenuator 22 all connected in series. The fricative path includes a modulator 24, a variable fricative-path attenuator 26, a nasal/fricative pole filter 28 and a nasal/fricative zero filter 30. The output of the glottal path and of the fricative path are connected to an output buffer 32 which provides a speech output. A pitch pulse generator 34 provides a periodic signal of a given frequency. A turbulence generator 36 is a pseudorandom white noise source. A rectifier 38 is connected between the output of the first formant filter 14 in the glottal path and the modulator 24 of the fricative path.

A plurality of switches are provided to reconfigure the synthesizer to produce the different classes of sounds. Switch S1 connected to the input of the glottal path at the glottal filter 12 selects between the pitch pulse generator 34 and turbulence generator 36. Switch S2 connected to the modulator 24 of the fricative path selects the rectified signal from the first formant filter 14 and rectifier 38 or a fixed value voltage which is shown as +1 volts. A third switch S3 connects the nasal/fricative pole and zero filters 28 and 30 to the output of the fricative attenuator 26 so as to form a fricative path or disconnects the nasal/fricative pole and zero filters from the fricative path and connect them to a link 40 which will be part of the glottal path. Switch S4 normally connects the output of the formant filters to the input of the glottal path attentuator 22 and may disconnect the formant filters from the glottal attentuator 22 and connect it to the nasal/ fricative pole and zero filters 28 and 30 via the link 40 and switch S3. Switch S5 normally connects the output of the nasal/fricative zero filter 30 to the output buffer 32 but may also disconnect it from the buffer 32 and connect it to the glottal attenuator 22. Switch S6 connects switch S4 either to the output of the fourth formant filter 20 or to the bypass link 42 which is connected directly to the output of the glottal filter 12. The position of the switches for the seven sound classes is illustrated in Table 1:

TABLE 1

| | FORMANT SYNTHESIZER SWITCH ASSIGNMENTS | | | | | |
|---|---|---|---|---|---|---|
| | VOWEL | ASPIRATE | NASAL | VOICE BAR | FRICATIVE OR STOP | VOICED FRICATIVE |
| $S_1$ | a | b | a | a | a | a |
| $S_2$ | b | b | b | b | b | a |

TABLE 1-continued

| FORMANT SYNTHESIZER SWITCH ASSIGNMENTS | | | | | | |
|---|---|---|---|---|---|---|
| | VOWEL | ASPIRATE | NASAL | VOICE BAR | FRICATIVE OR STOP | VOICED FRICATIVE |
| $S_3$ | a | a | a | a | b | b |
| $S_4$ | a | a | b | a | b | a |
| $S_5$ | a | a | b | a | a | a |
| $S_6$ | b | b | b | a | b | b |

The sixteen operational parameters required by the synthesizer architecture of FIG. 2 to generate speech and suggested ranges for most male speakers are described in Table 2. The respective points of input are noted in FIG. 2.

TABLE 2

| FORMANT SYNTHESIZER PARAMETERS | | | |
|---|---|---|---|
| Parameter | Description | Bits | Range |
| $F_0$ | *Pitch frequency | 5 | 0,65–160 Hz |
| $F_g$ | Glottal filter break frequency | fixed | 200 Hz |
| $F_1$ | *Center frequency of first formant | 4 | 200–800 Hz |
| $BW_1$ | Bandwidth of first formant | 4($F_1$ dependent) | 50–80 Hz |
| $F_2$ | *Center frequency of second formant | 4 | 800–2100 Hz |
| $BW_2$ | Bandwidth of second formant | 4($F_2$ dependent) | 50–100 Hz |
| $F_3$ | *Center frequency of third formant | 3 | 1500–2900 Hz |
| $BW_3$ | Bandwidth of third formant | 3($F_3$ dependent) | 130–200 Hz |
| $F_4$ | Center frequency of fourth formant | fixed | 3200 Hz |
| $BW_4$ | Bandwidth of fourth formant | fixed | 200 Hz |
| $F_z$ | *Center frequency of nasal/fricative zero | 3 | 600–2000 Hz |
| $BW_z$ | Bandwidth of nasal/fricative zero | 3($F_z$ dependent) | 100–300 Hz |
| $F_p$ | Center frequency of nasal/fricative pole | 3($F_z$ dependent) | 200 Hz (nasal), 1400–4000 Hz |
| $BW_p$ | Bandwidth of nasal/fricative pole | 3($F_z$ dependent) | 40 Hz (nasal) 320–800 Hz |
| $A_v$ | *Voicing amplitude | 3, (6 dB steps) | 0,0.016–1.0 |
| $A_F$ | *Fricative amplitude | 3, (6 dB steps) | 0,0.016–1.0 |

A brief review of Table 2 indicates that there are variable parameters signified by asterisks, parameters dependent on variable parameters and fixed parameters. The significance of this will be explained below. It should be noted that the number of bits for each of the variable parameters are for purposes of example and illustrates the efficiency of the present coding scheme.

Although FIG. 2 illustrates a specific vocal tract model, other models will use the formant parameters of Table 2 and thus the coding scheme of the present invention is not to be limited to any specific vocal tract model. The only requirement is that the synthesizer be a frame-oriented, formant synthesizer capable of accepting the variable parameters of Table 2. The apparatus of FIGS. 1 and 2 provide a background to better understand the present invention.

The speech data coding scheme of the present invention consists of binary bit packets, or commands, in four general categories. These commands are frame-oriented; one command per frame (10 msec nominal) is stored in the speech data memory. The four categories are: (1) sound initialization, requiring data for most or all of the parameters, (2) updates, requiring incrementing or decrementing a few parameters, (3) repeats, which require no data since the current sound is maintained and (4) terminals or halts, which signifies the end of a word (EOW) and thus requires no data. The commands consists of two parts, namely, header bits to indicate the class or category of command and parameter data bits.

To minimize the data rate during transmission of the command signals and to reduce memory capacity requirements, a bit-efficient coding scheme must be used. In the present scheme, the headers are generated using a technique similar to the well-known Shannon-Fano method. Each header is a bit string made up of a series of binary or logical "ones" (1) ended with a logical zero (0). The length of the header determines the command type. The synthesizer must read in from memory and decode each header and adjust its functional synthesis configuration to a form appropriate to produce the sound associated with the command. The shorter headers are assigned to the most frequently occurring commands to reduce bit rate.

Table 3 shows the resulting Shannon-Fano code, data structure and total bit length given the information of Table 2 for the thirteen proposed variable formant parameters. The REPEAT command, which has the most frequent occurance, is the shortest and consists of a single "0" bit and the voice bar and EOW (halt), which have the lowest frequency of occurance, are the longest with nine bits. The EOW does not end with a logical "0". All commands, except REPEAT and EOW, are structured such that the operating parameter data for each command code directly follow the corresponding header bits. During each speech frame, the synthesizer determines from the header bits which parameters are encoded in the data bits and then routes the data to their appropriate points within the system architecture for sound generation.

The initialize group consists of five types: VOWEL/ASPIRATE, FRICATIVE/STOP/PAUSE, NASAL, VOICED-FRICATIVE, and VOICE-BAR.

TABLE 3

| Command | Header | Data | Description | Total Bits |
|---|---|---|---|---|
| REPEAT | 0 | — | status quo (10 msec) do not alter configuration do not alter/update parameters | 1 |
| UPDATE 1 | 10 0 | $\Delta F_1$ $\Delta F_2$ $\Delta F_3$ | mod parameters | 6 |
| | 1 | $\Delta F_0$ $\Delta A$ $\Delta F_Z$ | | |
| UPDATE 2 | 110 | $\Delta F_0$ $\Delta F_1$ $\Delta F_2$ $\Delta F_3$ $\Delta F_Z$ | mod parameters | 8 |

TABLE 3-continued

| Command | Header | Data | | | | | | | Description | Total Bits |
|---|---|---|---|---|---|---|---|---|---|---|
| VOWEL/ASPIRATE | 1110 | $F_0$ | $F_1$ | $F_2$ | $F_3$ | $A_V$ | | | reset synthesizer configuration for vowel generation. Zero pitch ($F_0$ = 0 all bits) sets for aspirate generation. (10 msec) | 23 |
| FRICATIVE/STOP/ PAUSE | 11110 | $A_F$ | $F_Z$ | B | D | | | | reset configuration for fricative/stop. $B_{123}$ = 3 bit pause, 10 msec increments from 10 msec. $D_{123}$ = 3 bit fill, 10 msec increments from 0. | 17 |
| TRANSITION | 111110 | 0 | $\Delta F_0$ | $\Delta F_1$ | $\Delta F_2$ | $\Delta F_3$ | $\Delta A_V$ | | nasal-to-vowel | 12 |
| | | 1 | $\Delta F_0$ | $\Delta F_1$ | $\Delta F_2$ | $\Delta F_3$ | $\Delta A_V$ | $F_Z$ | vowel-to-nasal | 15 |
| NASAL | 1111110 | $F_0$ | $F_1$ | $F_2$ | $F_3$ | $A_V$ | $F_Z$ | | reset configuration for nasal generation. $F_p$ — 200 $H_z$, $BW_p$ — 40 $H_z$ (10 msec) | 29 |
| VOICED-FRICATIVE | 11111110 | $F_0$ | $F_1$ | $F_2$ | $F_3$ | $A_V$ | $A_F$ | $F_Z$ | reset configuration for v-fricative generation (10 msec) | 33 |
| VOICE BAR | 111111110 | $F_0$ | $A_V$ | | | | | | reset configuration for voice bar (10 msec) | 17 |
| END OF WORD | 11111111-10 | | | | — | | | | halt synthesis | 9 |

As shown in Table 3, each of these command is represented by a unique header followed by data bit string containing the parameter values necessary for the particular sound to be generated. These values correspond to the electrical parameters associated with FIG. 2 and the parameter symbols and the number of data bits of Table 3 are explained in Table 2 except for B and D which are explained in Table 3 as pause and fill durations, respectively. Upon decoding an initialize class header, the synthesizer must set itself into an appropriate architectural approximation to the human vocal tract for that sound. For the synthesizer of FIG. 2 this is accomplished by positioning the switches as listed in Table 1. The data is then used to drive the energy sources and signal filters to produce the intended synthetic sound. As the word "initialize" implies, these commands are coded into memory for frames which correspond to the beginning of a particular sound and for which a full set of data are required.

In order to reduce the amount of memory and bit rate for the longer initialization command signals, some of the formant parameters are fixed and others are made dependent on independent parameters so that they can be derived from the independent parameters. As indicated in Table 2, seven of the parameters, marked with an asterisk, are directly coded into the command data bits as independent variables. Six parameters are dependent variables required by the synthesizer, but are not placed directly into memory by the encoding process. Three fixed parameters are also listed; these are required by the synthesizer but need not be coded to memory since they are not variable. The number of binary bits (quantization levels) necessary to yield a 600 bps average bit rate are also listed in Table 2 for each parameter. The formant bandwidths are not independently compressed, but are intended to be decoded by the synthesizer from the data provided for their respective formant center frequencies. A set of "look-up tables" is required in the synthesizer implementation to accomplish this function. For a switched-capacitor hardware implementation, this look-up function is performed automatically by the capacitor values in the filter stages. For other hardware implementations, this look-up function would be served by a small ROM. In a software implementation, look-up could be accomplished by accessing a data file. Thus, by forcing the formant bandwidths to be functions of the formant frequencies, two parameters may be controlled via a single set of code bits. Similarly, the four nasal/fricative parameters $F_p$, $F_z$, $BW_p$, and $BW_Z$ are all coded via 3 bits of data for $F_Z$.

For a vowel sound, the data selects the pitch $F_0$ of the pitch generator, the center frequencies $F_1$, $F_2$, $F_3$ of the first three formant filters and the attenuation $A_V$ to the glottal attenuator using nineteen bits of data. The bandwidths of the three formant filters are derived from their respective center frequencies. The center frequency and bandwidth of the fourth formant filter is fixed. For an aspirate sound, the frequency $F_0$ of the pitch generator is set to zero and the turbulance generator is connected to the glottal path.

For unvoiced fricative, stop and pause sound generation, the data sets the attenuation $A_F$ of the fricative attenuator, the center frequency $F_Z$ of the frivative zero filter, the duration $B_{123}$ of a pause and the duration $D_{123}$ of a noise fill using twelve data bits. For an unvoiced fricative, the duration of the pause B is zero. For a pause, the amplitude $A_F$ of the fricative attenuator cen be set to zero and the duration is $(B+D)\times 10$ msec. For a stop, there is a gap of $B\times 10$ msec and a noise fill of $D\times 10$ msec. The center freqency $F_p$ and $BW_p$ bandwidth of the fricative pole filter and the bandwidth $BW_Z$ of the fricative zero filter are derived from the fricative zero center frequency $F_Z$.

For nasal sound generation, the data set the pitch frequency $F_0$, formant center frequencies $F_1$, $F_2$ and $F_3$, glottal attenuator amplitude $A_V$ and nasal zero filter center frequency $F_Z$ using 22 data bits. The bandwidths of the formant filters $BW_{1,2,3}$, the center frequency $F_p$ and bandwidths $BW_p$ of the nasal pole filter and the bandwidth $BW_Z$ of the nasal zero filter are derived.

For voiced fricatives, the same parameters as for the nasal sound generation are set and derived with the addition of the amplitude $A_F$ of the fricative attenuator which is set by the data using 25 data bits.

For a voice bar sound, the data selects the pitch $F_0$ of the pitch generator using the five data bits and the attenuation $A_V$ of the voice attenuator using three data bits. The frequency of the glottal filter is fixed, the formant filters are bypassed and the gain of the glottal attenuator is one.

Since segments, or phonemes, in human speech typically last longer than one frame, the coding scheme also provides the "update" and "repeat" command classes. The nature of human speech is such that its spectral and amplitude characteristics generally change slowly with time. Thus, initialize commands need only be coded for the starting frame of a given phoneme or sound segment. Thereafter, in most frames, repeats and updates may be coded. The REPEAT command consists of a single bit header which is not followed by data. A REPEAT code tells the synthesizer to continue generating its current sound for one more frame. The synthesizer must use its current set of data bits to do so since no new data is coded. A REPEAT may follow any other command, except EOW, including another REPEAT.

The update commands are coded when parameter data variations, or updates, are required during the synthesis of a particular sound or phoneme. Because such changes are typically small, only one data bit per parameter is coded using delta-modulation to increment or decrement one bit at a time. The delta modulation (DM) bits are indicated in Table 3 by a delta (Δ) preceding the parameter notation.

In the case of an initialize command, no delta-modulation process is involved and full n bit values for appropriate parameters are included in the data bits. The UPDATE 1 command allows limited parameter updates for cases when only a few parameters have changes between successive frames; namely either the center frequencies and bandwidths of the formant filters $F_1$, $F_2$, $F_3$ are adjusted or the pitch $F_0$, the attenuator gains A and the nasal parameters $F_Z$, $BW_2$, $F_p$, $BW_p$ are adjusted. The synthesizer by reading the header and the first data bit distinguishes which update is present for UPDATE 1. The UPDATE 2 command allows delta modulation of all parameters except the four nasal variables. The update commands thus provide a simple format for coding both allophone and phoneme transitions (diphones) within each sound class.

The TRANSITION command is also considered to be an update function in order to allow delta-modulation of some parameters across vowel-nasal and nasal-vowel phoneme boundaries. However, a synthesizer architecture change is required for TRANSITION commands, whereas no such changing is needed for UPDATES. Alternatively the NASAL and VOWEL/ASPIRATE initialize commands can be used instead at the cost of additional memory space.

For a nasal to vowel transition, the nasal pole and zero filters must be eliminated from the glottal signal path and the frequency of the pitch generator and the center frequencies and bandwidths of the formant filters adjusted. For a vowel to nasal transition, the nasal pole and zero filters must be inserted in the glottal signal path, its parameters initialized and the center frequencies and bandwidth of the formant filters adjusted.

It should be noted that for the vowel to nasal transition that the pitch, gain and formant filter center frequencies are in delta-modulation and the frequency of the nasal zero filter is non delta-modulation. Thus, the synthesizer by reading the header and the first data bit distinguishes between the different types of transitions each of which uses different data formats. An update command frame may follow any other command frame, except EOW, including other update commands.

The halt command is listed in Table 3 as EOW or "end-of-word". This command consists of a header without data bits and is coded into memory immediately following the last frame of a complete sound, phoneme, or full utterance. The EOW is interpreted by the synthesizer as a "shut-down" or "end of speech" command.

As is evident from Table 3, delta modulation is employed as an integral part of the present coding scheme in conjunction with the update class of commands, namely UPDATE 1, UPDATE 2 and transition. Through this the overall bit rate and memory storage requirements for the associated synthesizer used to reconstruct the encoded speech are reduced. A unique form of delta modulation is used which offers greater bit savings and versatility then conventional delta modulation techniques. As a first improvement, the present delta modulation uses a single bit coding not only to signify increments and decrements in the original signal, but also no change conditions as well. This permits coding of signals containing substantial steady-state segments and also reduces the net error in the reconstructed signal. A second major improvement is the use of specified update, transition commands and repeat commands which result in considerable savings in bit rate.

An encoding Table for the enhanced DM scheme is shown in Table 4.

TABLE 4

Decision Table for a DM encoder

| Original Waveform Level Change | Previous Frame Data Bit | Current Frame Data Bit |
|---|---|---|
| $V_L(x) = V_0(x) - V_0(x-1)$ | $P(x) = B(x-1)$ | $B(x)$ |
| increase 1 LSB | 0 | 1 |
| no change | 0 | 1* |
| decrease 1 LSB | 0 | 0 |
| increase 1 LSB | 1 | 1 |
| no change | 1 | 0** |
| decrease 1 LSB | 1 | 0 |

*For $P(x) = 0$ and $V_0(x-1) = -1$ LSB, $B(x) = 0$
**For $P(x) = 1$ and $V_0(x-1) = +1$ LSB, $B(x) = 1$ Since the DM bit B(x) can assume only one binary states during any frame x, and any one of three possible events may be coded, a comparison is made between the preceding frames DM bit, denoted by $P(x)=B(x-1)$, and the level change in $V_0(x)$ in order to set the state of current bit B(x). The level change is the difference signal $V_L$ introduced earlier, $$V_L(x)=V_0(x)-V_0(x-1)$$

where $V_0$ is the original quantized waveform, x is the number of the frame being coded, and $x-1$ represents the frame previously coded. For the case of simultaneous coding of multiple waveforms or parameters, the decision process of Table 4 may be applied for each separate waveform during each frame x.

A corresponding decoder table is given in Table 5.

TABLE 5

Decision Table for a DM Decoder

| P(x) | B(x) | Response |
|---|---|---|
| 0 | 0 | decrement $V_R$ 1 LSB |
| 0 | 1 | no change |
| 1 | 0 | no change |

TABLE 5-continued

| Decision Table for a DM Decoder | | |
|---|---|---|
| P(x) | B(x) | Response |
| 1 | 1 | increment $V_R$ 1 LSB |

The decoder table is used by a receiving system to reconstruct a synthetic waveform $V_R$ which relates closely to $V_0$. The receiver performs this reconstruction by accessing the stored (or transmitted) DM bit string B at a rate of one bit per encoded waveform per frame. The receiver then compares, for each frame x, the current bit B(x) with the previous bit P(x), which has been saved, and adjusts $V_R$ accordingly. Then, P(x+1) is set equal to B(x), B(x+1) is received, and the comparison and reconstruction process is repeated for frame x+1. To generate a complete reconstructed signal $V_R$, this process must be repeated iteratively for each frame of $V_0$ originally encoded. For the case of simultaneous decoding of multiple waveforms or parameters, the decision process of Table 5 may be applied for each separate waveform during each frame x.

An examination of Tables 4 and 5 reveals that waveforms reconstructed from DM codes cannot change directly from an increment in frame x to a decrement in frame x+1, or vice-versa. Since the decoder requires P(x) and B(x) to be identical in any frame x in order to increment or decrement $V_R$, two frames are required to reverse the direction of change. The first frame has a code equivalent to a no change, namely the present bit B(x) is opposite the previous bit P(x) and the second frame provides the consecutive state, namely, the present bit B(x) equals the previous bit P(x). This restriction results in a smoothing effect in $V_R$ during frames when $V_0$ alternates states successively. Also, in some cases, two frames may be required to increment or decrement $V_R$ from a "no change" state. This occurs where the previous bit P(x) of a no change state is opposite in value from the desired present bit B(x) valve. Thus, one bit is needed to reverse the sequence and a second bit is required to provide a consecutive match.

Thus, ±1 LSB variations in $V_R$ may lag associate changes in $V_0$ by one frame in time. To insure that $V_R$ tracks $V_0$ as closely as possible, the encoding algorithm must determine when this lagging effect is present and adjust its coding procedure accordingly. This determination is best made by computing a value $V_D$ which is the difference between $V_0$ and $V_R$. This difference signal, expressed as $$V_D(x)=V_0(x)-V_R(x),$$

is computed for each coded waveform during each frame x, then, in the following frame, if the value of $V_D$ is non-zero, a modification in the encoding process is performed as stated in the footnote to Table 4. This modification allows $V_R$ to "catch up" with $V_0$ during frames when $V_0$ is not changing. The scheme automatically catches up where $V_D=-1$, P(x)=0 and an increase is required. The present bit B(x) is encoded as a 1 which with a previous bit P(x) of 0, will be decoded as a no change and thus increases will cancel the negative lag. The same is true when $V_{D=+}1$, P(x)=1 and a decrease is required. The present bit B(x) is encoded as a 0.

The preceding description of the new Delta Modulation methodology can be applied to speech data encoding as follows. The decoding function is performed by a receiver which in the present example is a formant-based speech synthesizer or its functional equivalent. The $V_0$ waveforms are taken to be quantized speech parameter levels generated by any appropriate speech parameter tracking and analysis algorithm, either with or without user interaction, as necessary. One $V_0$ signal is required for each independently coded speech parameter. Using the formant-based parameters of Table 3, a separate $V_0$ signal would exist for $F_0$, $F_1$, $F_2$, $F_3$, $F_Z$, $A_V$, and $A_F$.

The parameter encoding algorithm assigns a separate pair of DM bits, B(x) and P(x) to each independently coded parameter. A similar bit-pair assignment is obviously required in the synthesizer (receiver) for each parameter. During any frame in which an initialize class command is coded, each B(x) bit for each associated parameter is preset to a given logical state. This state may be either a 1 or 0; it is necessary only that the preset state be consistent for all DM data bits and all preset events. Then, during the coding of any speech frame to which an update (UPDATE1, UPDATE2, TRANSITION) is to be assigned, the B(x) bits required by the particular update command are given logical states as dictated by Table 4. Note that parameter level variations greater than ±1 LSB must be smoothed prior to coding or accounted for with an initialize command.

Figure 3:
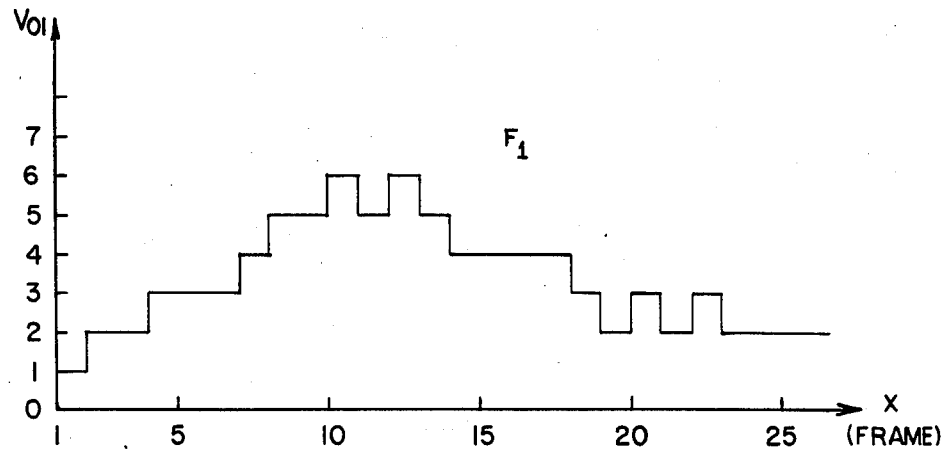
FIGS. 3 and 4 are graphs of quantization level of parameters 1 and 2 as a function of frame numbers.
Figure 4:
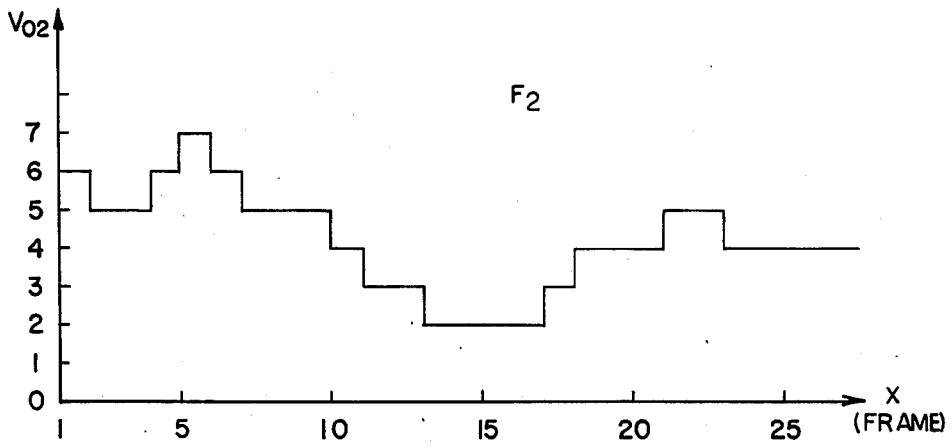

As an example, consider encoding the B(x) bits for arbitrary $V_0$ waveforms associated with any two speech parameters, say $F_1$ and $F_2$. Let $F_1$ and $F_2$ be quantized to four bits each as suggested in Table 3, and let the time variation of the associated quantized values be $V_{01}$ and $V_{02}$, respectively, over a total of 25 frames as illustrated in FIGS. 3 and 4. The results of the encoding process are shown in Table 6 for both parameters.

TABLE 6

| | $F_1$ | | | | $F_2$ | | | | |
|---|---|---|---|---|---|---|---|---|---|
| Frame Number X | $F_1$ level change $V_{L1}(x) = V_{01}(x) - V_{01}(x-1)$ | Previous Bit $P_1(x)$ | Current Bit $B_1(x)$ | $V_{01}(x)$** | $F_2$ level change $V_{L2}(x) = V_{02}(x) - V_{02}(x-1)$ | Previous Bit $P_2(x)$ | Current Bit $B_2(x)$ | $V_{02}(x)$** | Coded Command |
| 1 | | | 1 | 0 | | | 1 | 0 | Initialize Update |
| 2 | + | 1 | 1 | 0 | — | 1 | 0 | −1 | Initialize Update |
| 3 | NC | 1 | 0 | 0 | NC | 0 | 0 | 0 | Initialize Update |
| 4 | + | 0 | 1 | +1 | + | 0 | 1 | +1 | Initialize Update |
| 5 | NC | 1 | 1 | 0 | + | 1 | 1 | +1 | Initialize Update |
| 6 | NC | 1 | 0 | 0 | — | 1 | 0 | 0 | Initialize Update |
| 7 | + | 0 | 1 | +1 | — | 0 | 0 | 0 | Initialize Update |

TABLE 6-continued

| Frame Number X | $F_1$ level change $V_{L1}(x) = V_{01}(x) - V_{01}(x-1)$ | Previous Bit $P_1(x)$ | Current Bit $B_1(x)$ | $V_{01}(x)$** | $F_2$ level change $V_{L2}(x) = V_{02}(x) - V_{02}(x-1)$ | Previous Bit $P_2(x)$ | Current Bit $B_2(x)$ | $V_{02}(x)$** | Coded Command |
|---|---|---|---|---|---|---|---|---|---|
| 8 | + | 1 | 1 | +1 | NC | 0 | 1 | 0 | Initialize<br>Update |
| 9 | NC | 1 | 1 | 0 | NC | 1 | 0 | 0 | Initialize<br>Update |
| 10 | + | 1 | 1 | 0 | — | 0 | 0 | 0 | Initialize<br>Update |
| 11 | — | 1 | 0 | −1 | — | 0 | 0 | 0 | Initialize<br>Update |
| 12 | + | 0 | 1 | 0 | NC | 0 | 1 | 0 | Initialize<br>Update |
| 13 | — | 1 | 0 | −1 | — | 1 | 0 | −1 | Initialize<br>Update |
| 14 | — | 0 | 0 | −1 | NC | 0 | 0 | 0 | Initialize<br>Update |
| 15 | NC | 0 | 0 | 0 | NC | 0 | 1 | 0 | Initialize<br>Update |
| 16 | NC | 0 | 1 | 0 | NC | 1 | 0 | 0 | Initialize<br>Update |
| 17 | NC | 1 | 0 | 0 | + | 0 | 1 | +1 | Initialize<br>Update |
| 18 | — | 0 | 0 | 0 | + | 1 | 1 | +1 | Initialize<br>Update |
| 19 | — | 0 | 0 | 0 | NC | 1 | 1 | 0 | Initialize<br>Update |
| 20 | + | 0 | 1 | +1 | NC | 1 | 0 | 0 | Initialize<br>Update |
| 21 | — | 1 | 0 | 0 | + | 0 | 1 | +1 | Initialize<br>Update |
| 22 | + | 0 | 1 | +1 | NC | 1 | 1 | 0 | Initialize<br>Update |
| 23 | — | 1 | 0 | 0 | — | 1 | 0 | −1 | Initialize<br>Update |
| 24 | NC | 0 | 1 | 0 | NC | 0 | 0 | 0 | Initialize<br>Update |
| 25 | NC | 1 | 0 | 0 | NC | 0 | 1 | 0 | Initialize<br>Update |

* "+" = 1 LSB increment
** LSB
"−" = 1 LSB decrement
"NC" = No change

TABLE 7

| Frame Number X | Coded Command |
|---|---|
| 1 | Initialize |
| 2 | Update |
| 3 | " |
| 4 | REPEAT |
| 5 | Update |
| 6 | REPEAT |
| 7 | Update |
| 8 | " |
| 9 | " |
| 10 | " |
| 11 | " |
| 12 | REPEAT |
| 13 | REPEAT |
| 14 | Update |
| 15 | " |
| 16 | REPEAT |
| 17 | REPEAT |
| 18 | Update |
| 19 | " |
| 20 | REPEAT |
| 21 | REPEAT |
| 22 | Update |
| 23 | REPEAT |
| 24 | Update |
| 25 | REPEAT |

Referring to Table 6, the current frame DM data bits $B_1(x)$ and $B_2(x)$ are preset to logical state 1 at frame 1 which is coded as an initialize command. Then, using Table 4 and the information in each $V_L$ column in Table 6, logical states for $B_1(x)$, $B_2(x)$ and $P_1(x)$, $P_2(x)$ are derived for each frame x. Note that the $P_1(x)$, $P_2(x)$ states for each frame x are the $B_1(x)$, $B_2(x)$ states, respectively, for the preceding frame $x-1$, i.e., $P_1(x)=B_1(x-1)$, $P_2(x)=B_2(x-1)$. Table 5 is applied during each frame to the P(x) and B(x) bits to generate levels $V_{R1}(x)$ and $V_{R2}(x)$ for the reconstructed waveforms. The only purpose the reconstructed signals $V_{R1}$ and $V_{R2}$ serve in the encoder is to provide necessary input to generate the difference signals $V_{D1}$ and $V_{D2}$. For frames where changes in the reconstructed waveforms lag changes in the original signals, the difference signals are used to modify the coding process per the footnote in Table 4. The values of the difference signals $V_{D1}$ and $V_{D2}$ for this particular example are listed frame by frame in Table 6. The resulting command codes generated by the encoding algorithm are shown in the right-hand column of Table 6.

The synthesizer (receiver) assembles $V_{R1}(x)$ and $V_{R2}(x)$ by performing a preset event identical in state to the encoder for each initialize command and using the absolute parameter data stored (or transmitted) with the initialize header to establish the initial parameter levels $V_{R1}(1)$ and $V_{R2}(1)$ for frame 1. Thereafter, for each frame during which an update command is received, the states of $B_1(x)$ and $B_2(x)$ are read (or received) and compared with $P_1(x)$ and $P_2(x)$ via Table 5 and $V_{R1}(x)$ and $V_{R2}(x)$ are altered in level as required. For any frame coded as a REPEAT, the synthesizer sets all B(x) bits artificially by forcing $B(x)=\overline{P(x)}$ for each parameter. This allows the synthesizer to reconstruct the two-bit "no-change" code for the data-less REPEAT command.

This example has been limited to two parameters for the sake of brevity and clarity and can be extended to all seven independent formant-based parameters with no loss in generality.

It is now possible to observe and understand a major inefficiency in the coding process used to generate Table 6. Observe that update commands or changes from a 1 to a 0 or a 0 to a 1 are generated for frames 4, 6, 12, 13, 17, 20, 21, and 23 in spite of the fact that no parameter changes occur in the reconstructed signals during those frames. Thus, update commands are coded for frames in which the net effect is as though a REPEAT were present. Therefore, bits are being wasted. Only during frames 16 and 25 are REPEAT commands actually coded. Generally, the REPEAT command would be coded with greater frequency in a "typical" segment of speech. However, the waveforms of FIGS. 3 and 4 are perfectly valid for speech segments whose phonetic content is rapidly changing.

To correct this inefficiency, the following enhancement of this coding scheme over conventional Delta Modulation is invoked. During the encoding process, for any potential UPDATE1 or UPDATE2 frame x, the encoder algorithm checks each parameter for a no change condition in the corresponding frame of the associated reconstructed waveform $V_R$. This is done by comparing P(x) and B(x) via Table 5. If all reconstructed parameters do not change levels during that frame, i.e. $B(x)=P(x)$, regardless of whether the original $V_0$ waveforms are changing, the frame is coded as a REPEAT rather than an update. Then $P(x-1)$ is set equal to B(x) as would occur anyway for an update frame, and coding proceeds to the next frame.

The effect of this update-to-repeat transformation scheme upon the encoding of the waveforms of FIGS. 3 and 4 is shown in Table 7. Comparing Table 7 to the right-hand column of Table 6 reveals that a total of 8 update commands were replaced with single-bit REPEAT commands resulting in a bit savings of either 5 or 7 bits per frame, depending on whether an UPDATE1 or UPDATE2 was replaced.

The use of a repeat instead of an update in the delta modulation encoding provides savings in addition to the use of updates 1 and 2 and transition codes as substitutes for initialization frames. During the encoding process for any potential UPDATE2 frame x, the encoder algorithm checks for a no change condition in the P(x), B(x) bits for either (a) $F_0$, and $F_Z$ simultaneously, or (b) $F_1$, $F_2$, $F_3$ simultaneously. If condition (a) is true, the frame is coded as an UPDATE1 in which the first data bit following the header is a logical 0 and the delta modulation code for parameters $F_1$, $F_2$, $F_3$ are used. If condition (b) is true, the frame is coded as an UPDATE1 in which the first data bit following the header is a logical 1 and the delta modulation code for parameters $F_0$ and $F_Z$ are used.

Note that for any frame in which either $A_F$ or $A_V$ must be changed via DM, an UPDATE1 is required. If the update occurs during synthesis of a vowel, aspirate, nasal or voice bar, the A bit corresponds to $A_V$. If the update occurs during synthesis of a fricative, stop or pause, the A bit refers to $A_F$. During an update on the amplitude of a voiced-fricative, the A bit is assigned to both $A_V$ and $A_F$ and both amplitude levels are changed in unison. Laboratory experimentation has indicated no effect on speech quality from enforcing this rule.

Figure 5:
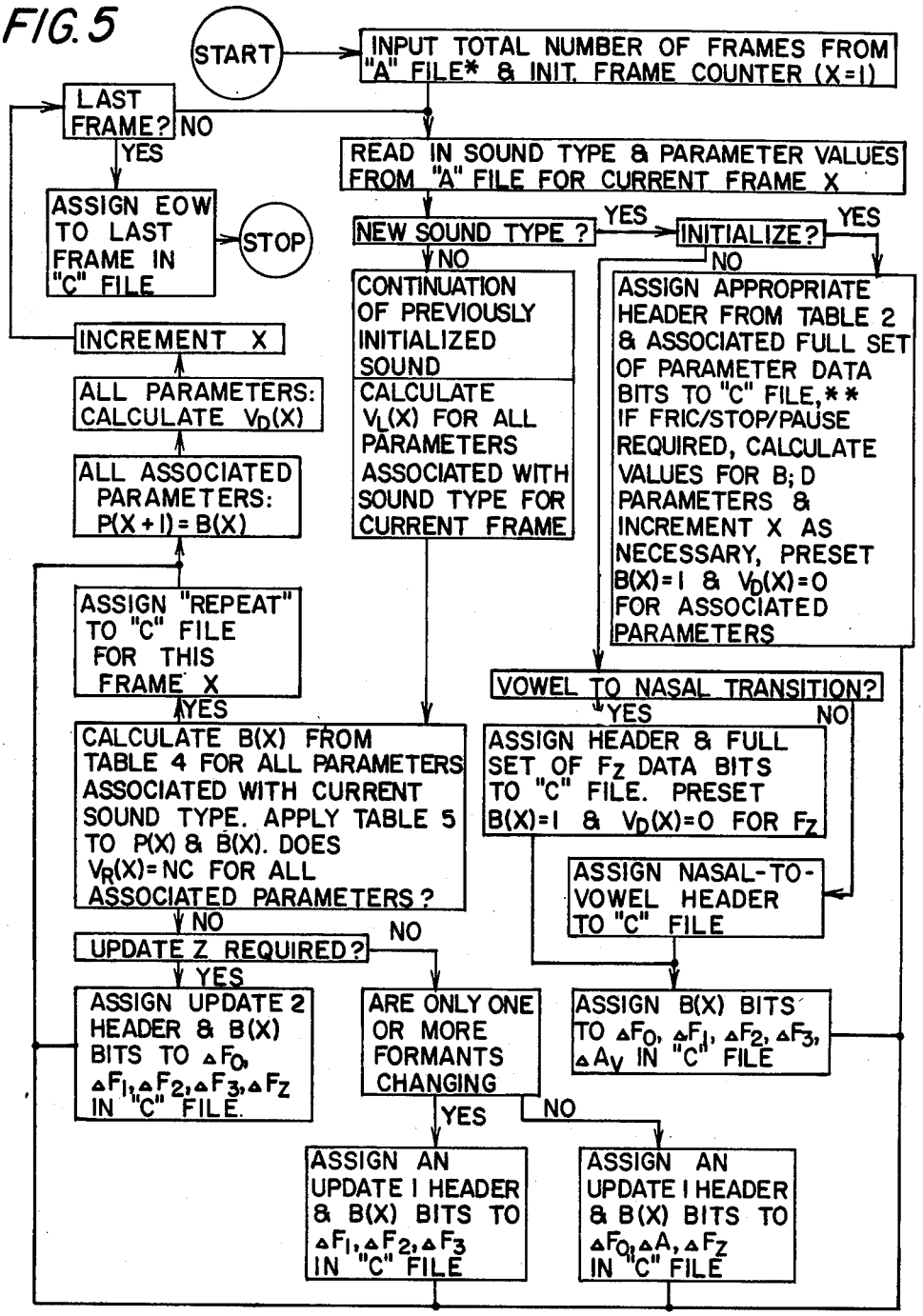
FIG. 5 is a flow chart of the encoder.
Figure 6:
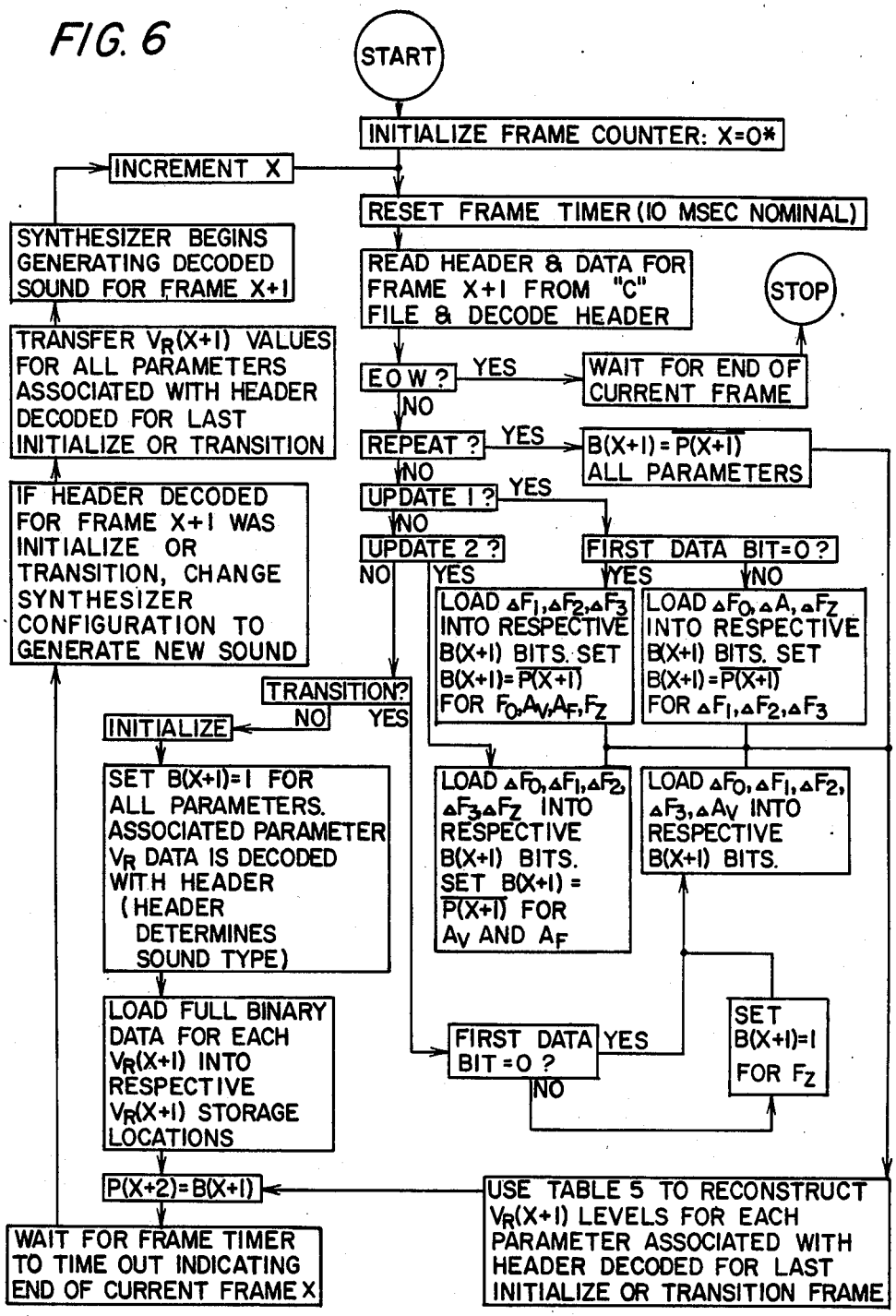
FIG. 6 is a flow chart of the decoder.

This enhanced and bit-efficient scheme for replacing update commands with REPEAT's or shorter updates is relatively transparent to the synthesizer, which simply reads headers and data from memory and decodes the bits as described above. FIGS. 5 and 6 contain flowcharts which show the functional structure of the encoder and decoder, respectively. It should be noted that the flowcharts are intended to most clearly indicate and detail aspects of the update process and the handling and control of the Delta Modulation bits.

For any single speech parameter coded via the flowchart of FIG. 5, a potential maximum of 50% of all updates may be replaced with either a REPEAT or a shorter update. Since variations in several parameters must be considered simultaneously, the effective bit savings is less due to limited correlation between parameter changes. A typical reduction in bit rate of between ten and twenty percent compared to coding without removing ineffective updates has been observed after extensive coding of both isolated and connected speech.

Figure 7:
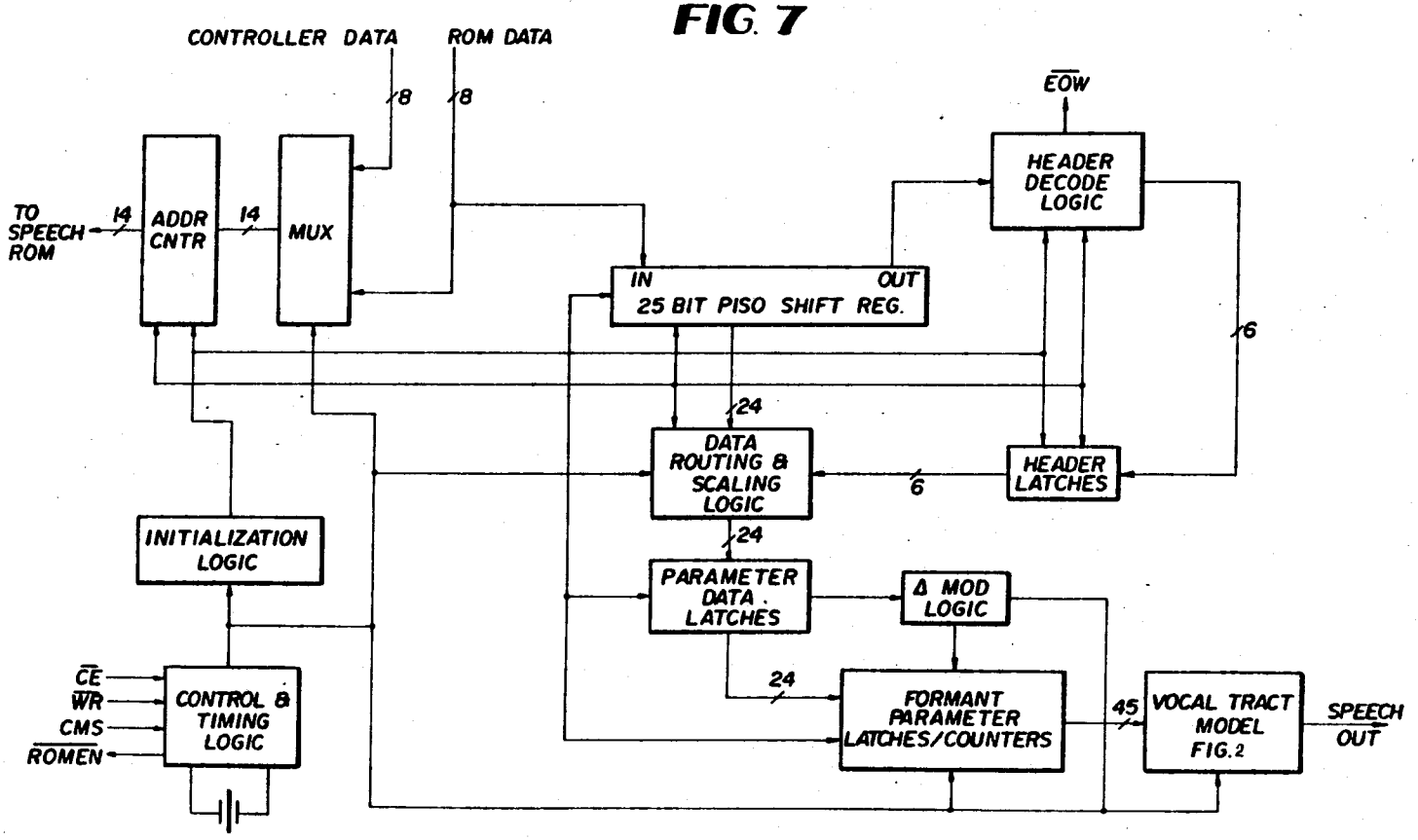
FIG. 7 is a block diagram of the speech synthesizer architecture incorporating the vocal track model of FIG. 2.

A functional diagram of the synthesizer architect are capable of operating with the coding scheme of the present invention is illustrated in FIG. 7. The multiplexer and fourteen bit address counter hold ROM access while the twenty-five bit PISO counter buffer converts the eight bit parallel speech data into a serial bit stream for decoding and distribution. The header decode logic and latches identify the type of sounds (vocal, nasal, etc.) to be generated and route the incoming data into the appropriate parameter latches for comparison with the previously transmitted data. The new data is blended with the old data via delta modulation and the resulting format parameters are applied to the vocal tract circuitry of FIG. 2. Since the elements of FIG. 7 are well known, they are not described in detail.

From the preceding description of the preferred embodiment, it is evident that the object of the invention are attained. By using seven independent formant parameters to represent and generate thirteen formant parameters for eight sound types and Shannon-Fano coding with a unique delta-modulation method, natural sounding speech at bit rate of 500 to 600 bits per second is attained. Although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. In a formant based speech synthesizer, including at least three formant filters, a pitch and turbulence generator, spectral filter, nasal zero and pole filters, glottal and fricative attenuators, and control means for controlling the configuration and parameters of the above elements, the improvement being said control means which comprises:

storing means for storing command signals each of which includes a first portion indicating the type of command signal and a second portion indicating values of a first set of synthesizer parameters;

said first portion of said command signals indicating initialization of sound classes, repeating the previous command signal, updating previous command signals and end of word types of command signals;

determining means connected to said storing means and responsive to said first portion of said command signal for determining the configuration of said synthesizer to produce a class of sound; and producing means connected to said storing means and responsive to said second portion of said command signals for producing values for a second set of synthesizer parameters as a function of said values of said first set of synthesizer parameters;

adjusting means connected to said storing means and said producing means for adjusting the operating characteristics of said synthesizer as a function of said first and second set of synthesizer parameters.

2. A formant based speech synthesizer according to claim 1 wherein initialization command signals have the greatest bit lengths, and said repeat command signal has the shortest bit length.

3. A formant based speech synthesizer according to claim 1, wherein said second portion of said updating command signals are in delta modulation and including decoding means responsive to said first portion of said command signal indicating an update for decoding the delta modulated second portion of said command signal and changing said first set of synthesizer parameters.

4. A formant based speech synthesizer according to claim 3 wherein the first bit of the second portion of an update command signal further indicates the class of updates and said delta-modulation decoding means does not decode said first bit.

5. A formant based speech synthesizer according to claim 3 wherein said updating command signals include sound class transition command signals having a shorter bit length than said sound class initialization command signals.

6. A formant based speech synthesizer according to claim 5 wherein said determining means is responsive to first portion of a transition command signal and said delta-modulation decoding means is responsive to the second portion of a transition command signal.

7. A formant based speech synthesizer according to claim 6 wherein the first bit of the second portion of a transition command signal further indicate the class of transition and said delta-modulation decoding means does not decode said first bit.

8. A formant based speech synthesizer according to claim 7 wherein for one class of transition command signal said delta-modulation decoding means decodes less than all of said second portion in addition to said first bit.

9. A formant based speech synthesizer according to claim 1, wherein said first portion of said command signal indicates a vowel or aspirate sound class, fricative or stop or pause sound class, nasal sound class, voiced fricative sound class or voice bar sound class.

10. A formant based speech synthesizer according to claim 9 wherein said second portion of a command signal for a vowel or aspirate sound class includes a zero frequency value for said pitch generator for an aspirate sound.

11. A formant based speech synthesizer according to claim 9 wherein said second portion of a command signal for a fricative or stop or pause sound class includes a fricative attenuator value, silence duration value and fill duration value and including means connected to said storing means and responnsive to said first and second portion of said command signal identifying a fricative or stop or pause sound class for controlling said adjusting means for periods determined by said silence and duration values to produce fricative, or stop or pause sounds.

12. In a formant based speech synthesizer, incluiding at least three formant filters, a pitch and turbulence generator, spectral filter, nasal zero and pole filters, glottal and fricative attenuators, and control means for controlling the configuration and parameters of the above elements, the improvement being said control means which comprises:

storing means for storing command signals each of which includes a first portion indicating the type of command signals and a second portion indicating values of a first set of synthesizer parameters;

determining means connected to said storing means and responsive to said first portion of said command signal for determining the configuration of said synthesizer to produce a class of sound;

producing means connected to said storing means and responsive to said second portion of said command signals for producing values for a second set of synthesizer parameters as a function of said values of said first set of synthesizer parameters;

said first set of synthesizer parameters including pitch generator frequency, first, second and third formant filter center frequencies, nasal zero filter center frequency and glottal and fricative attenuator amplitudes; and said second set of synthesizer parameters produced including first, second and third formant filter bandwidths, nasal pole filter center frequency and nasal pole and zero filter bandwidths; and adjusting means connected to said storing means and said producing means for adjusting the operating characteristics of said synthesizer as a function of said first and second set of synthesizer parameters.

13. A formant based speech synthesizer according to claim 12 including a fourth formant filter having a fixed center frequency and bandwidth; and wherein the break frequency of said spectral filter is fixed.

* * * * *